US005088780A

United States Patent [19]

Doherty

[11] Patent Number: 5,088,780

[45] Date of Patent: Feb. 18, 1992

[54] LOCK-KEEPER SECURITY SHIELD PLATE

[76] Inventor: William Doherty, 938 Westview Dr., Louisville, Ky. 40214

[21] Appl. No.: 722,207

[22] Filed: Jun. 27, 1991

[51] Int. Cl.[5] ..... E05C 21/00

[52] U.S. Cl. ..... 292/346; 292/340

[58] Field of Search ..... 292/340, 346; 411/594, 411/545, 155, 156, 910

[56] References Cited

U.S. PATENT DOCUMENTS

| | | | |
|---|---|---|---|
| D. 302,937 | 8/1989 | Briggs | 292/346 X |
| 1,091,453 | 3/1914 | Fletcher | 292/346 X |
| 2,631,881 | 3/1953 | Trachsler | 292/346 |
| 3,133,378 | 5/1964 | Poupitch | 411/544 X |
| 3,154,343 | 10/1964 | Devine | 292/346 |
| 3,279,840 | 10/1966 | Barone | 292/346 |
| 4,383,709 | 5/1983 | Ronan | 292/346 |

*Primary Examiner*—Richard E. Moore

[57] ABSTRACT

A lock-keeper security shield plate assembly arranged over the usual lock-keeper plate which is in a routed recess of the wooden door jamb lock rail. The reinforcing shield plate is zig-zag shaped having an upset center section and two integrally formed angle face plates, shaped for one said shape to fit all width door frames with door stop rails that also vary in face width. One said face plate defines a bolt opening that is to be aligned with a bolt aperture of an underlying lock-keeper plate of a dead bolt mechanism, the other face plate defines a screw aperture in a key location in relation to a tubular dead bolt lock cylinder assembly mounted on a said door that virtually prevents tampering with the elongated anchor screw driven through said screw hole, through face of stop rail of wood jamb and framing studs there behind, said location of anchor screw in space relation to said lock cylinder rim prevents the removal of said anchor screw (door closed). Other means to protect said screw are shown in several modified drawings.

8 Claims, 3 Drawing Sheets

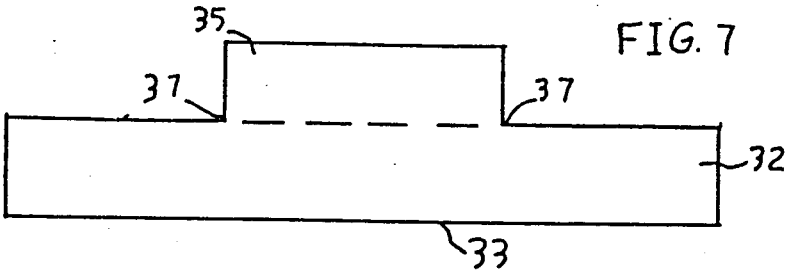
FIG. 7
FIG. 5
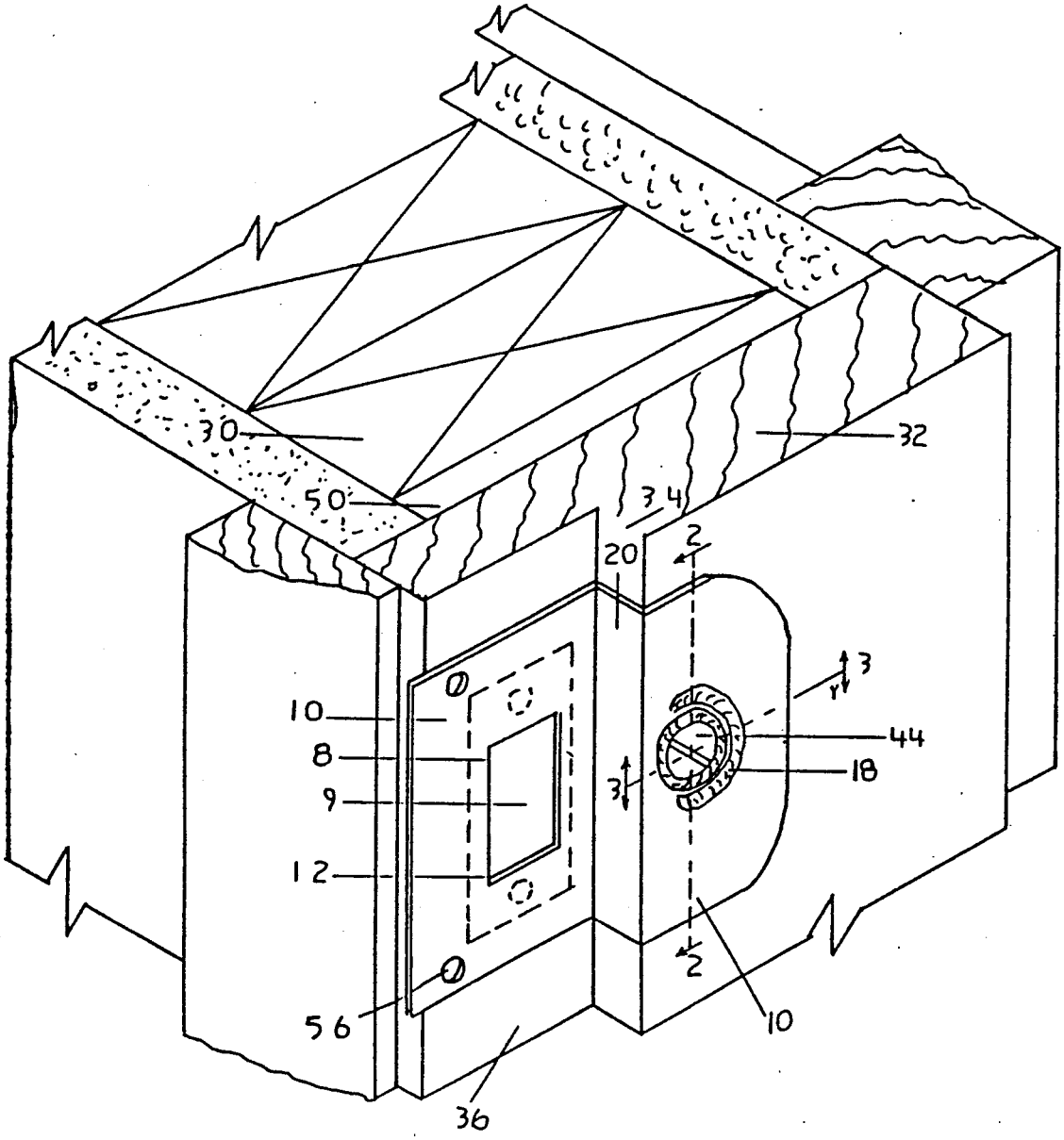

LOCK-KEEPER SECURITY SHIELD PLATE

FIELD OF THE INVENTION

The present invention relates to an improved protective reinforcing lock-keeper security shield plate designed for use in combination with the existing lock-keeper mounted in a recess in the lock rail of a wood door jamb and it relates to a method for installing and anchoring said shield plate and a key location for main anchor screw that virtually prevents tampering when used with a tubular dead bolt lock assembly mounted on a swingable door, closed and locked.

1. Background of the Invention

The extreme weakness of the tubular dead bolt lock-keeper and mounting of the type furnished with said lock or the like which are used on exterior doors of homes are unable to resist forceable entry to any reasonable degree due to the poor means of the mounting said lock-keeper in the recessed, thin portion of a wood door jamb lock rail that is milled for the door and provides a door stop portion a one inch hole or socket is bored completely through said portion of jamb lock rail for the one inch throw of a deadbolt lock leaving very little wood between the inner edge of said lock bolt hole and the inner edge of jamb lock rail and a mortise is routed for the lock-keeper plate to be mounted in and anchored with two screws through screw holes in plate to door jamb lock rail. Lock-keeper encompasses and aligns lock bolt hole in keeper with said hole in lock jamb rail. The assembly is provided for a tubular deadbolt or the like lock bolt to pass through to interlock with said lock-keeper. This means provides very little strength when it comes to forced entry. The use of strong tubular dead bolt lock or the like with a strong lock bolt are of no avail so long as the inherent weak arrangement of the dead bolt lock-keeper and mounting is adhered to.

2. Description of Related Technology

U.S. Pat. No. 4,195,870 issued to Percoco, FIGS. 6 and 7 discloses a security striker plate assembly secured to a wood door frame of which plate is so shaped wherein the striker plate is angled so as to extend around a door frame to include the door stop portion, this jamb wrap around design is said plates main support even though said plate is anchored with screws 55 at portion 58 and screws 55 portion 57 they depend largely on the door jamb for support said screws 58 portion 57 would be to close to inner edge said beam 32 to add any effective support to said plate.

Face width size of a door jamb and stop rail, vary based on the exterior wall thickness of which is based on wall studs width, exterior storm sheeting thickness, brick veneer, wood, vinyl or aluminum siding, etc. interior wall covering used drywall lath and plaster and etc. Such thickness of walls vary and has changed over the years and are still changing. Percoco modified design FIGS. 6 and 7 wherein striker plate is angled so as to extend around a door frame is believed to be designed and fabricated to fit a particular door frame width of which institution fabricate such plate for their facilities.

U.S. Pat. No. 3,888,530 issued to Fabrici shows frame guard 14 in FIG. 2 and explains in column 4 lines 45–50 being U-shaped is formed pre-dimensioned to fit a standard width of one size door jamb and stop rail portion and would be best suited for fitting in new construction.

U.S. Pat. No. 3,764,173 issued to Griffith shows in FIGS. 2A and 2B a shaped door jamb and stop rail shield 26 formed and shaped to fit across the jamb and stop rail and extend along the inside and outside walls of the said jamb, see column 2 line 65. FIG. 5 striker plate 49 mounted over face of said shield 26 would constitute an uusightly and unacceptable element to most home owners and provide no means to adjust door to door stop.

Both Fabrici and Griffith are very similar to Percoco FIGS. 6 and 7 and also suffer from the same problem as does percoco in the area that they all are designed and shaped to fit only one size or face width of a jamb lock rail.

U.S. Pat. No. 3,967,845 issued to Governale FIG. 3 a reinforcement plate 17 of the invention and the conventional striker plate 18 also jamb 10 and stop rail !1, see brief description of drawing FIG. 3 invention in relation to a door frame which has been prepared in advance to accept the invention. Such reinforcing striker plate assembly is believed to be designed to fit a particular door jamb of which institution fabricate such plates for use in their facilities.

U.S. Pat. No. 3,815,945 issued to Lamphere discloses a door frame security plate designed to prevent the door from being forced open with hard kicks by preventing jamb lock rail from spliting. The Lamphere device uses a specially milled jamb lock rail interlock with an enlarged configured and extended strike plate perforated to receive more than the customary number of fastening screws. This apparatus requires additional weakening of the jamb rail by milling out a deep seat for said plate. Column 3 line 5–8, FIG. 4 shows that the edge of the door frame security plate 10 is beveled as at 58 to serve as a striker plate lip, since the security plate eliminates the conventionally known, striker plate now this also eliminates means to adjust door to door stop rail. Such door frame security strike device requires extensive modification of the said door jamb lock rail in order to install said plate and would be expensive to manufacture and very difficult to install.

U.S. Pat. No. 4,186,954 issued to Detlef.

U.S. Pat. No. 4,211,442 issued to Hansen.

Both are similar in that they require a large rectangular shaped hole to be cut completely through jamb lock rail for the lock bolt housing of which weakens the lateral or horizontal strength of the lock strike and eliminates the conventionally known strike plate which is needed to adjust the door to the door stop rail. To install such design lock-keeper in a 1⅜" door jamb of a house with lath and plaster interior walls said lock keeper would be of no avail in that the said brace member 7 of Detlefs and the main anchoring screw 12 in the Hansen device are depending on said anchor for support against force entry would not be of any avail, said anchors would pass between the stud framing construction and the interior plastered walls neither would prevail if body force or hard kicks were applied for forced entry. For such spacing see my scale drawing of FIGS. 5 and 6 ¾=1".

In view of the various tools a determined burglar has the option of using such as a battery operated small saber saw that can cut away the door lock assembly used on wood doors or wood jambs in about two minutes, why overdo a security locking device?

SUMMARY OF INVENTION

It is an object of the present invention to provide an improved lock-keeper security shield plate reinforcement assembly comprising a small sheet metal plate designed in a zig-zag shape for one said shape to fit all width door frames with door stop rails that also vary in face width, based on the construction material used in the exterior walls. The said zig-zag shape shield plate having an upset center section for a door stop rail and two intergrally formed alternate angle plate, a lower face plate defines an opening for passage of a lock bolt of a dead bolt lock said opening of said shield plate being aligned with the bolt hole of the existing lock-keeper, and held in place with two self threading flat head screws in concial countersunk apertures provided one above and one below the said existing dead bolt lock-keeper, an upper face plate that laps onto said door stop face and defines a key aperture in a preferred location for a large elongated screw that anchors said plate through said aperture in space relation to a tubular dead bolt lock cylinder rim virtually prevents tampering with said anchor screw head and prevents removal of said screw when door is closed and locked with said tubular dead bolt lock or the like.

It is another object of the present invention to provide an improved lock-keeper security shield plate assembly that virtually prevents forced entry by a would be intruder using body force or hard kicks with the foot, a shield plate to reinforce the existing lock-keeper, said lock-keeper security shield plate assembly that mounts without disturbing the existing conventional lock-keeper or any part of the tubular dead bolt lock assembly mounted on a door and door jamb. A device that is designed for a do it yourself homeowner item that only requires a drill for pilot hole and a screwdriver to install.

BRIEF DESCRIPTION OF THE DRAWINGS

FIG. 5 is a pictorial view of my invention of FIG. 3A shown in operative relation with the existing conventional lock-keeper as mounted on a door frame and wall combination; in fragment.

FIG. 7 is an end view of an interior door jamb lock rail with door stop rail in center of jamb rail.

DETAILED DESCRIPTION OF MY INVENTION

Figure 1A:
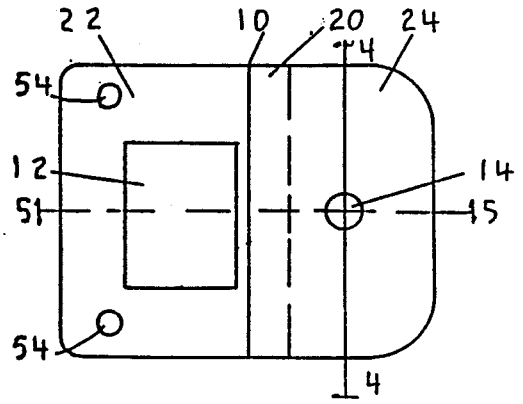
FIG. 1 A is a perspective view of the lock-keeper security shield plate and key aperture in a preferred position.
FIG. 1B is a cross section view of said shield plate along line 5—5 of 1 A.
FIG. 1C is a side view of the invention showing the main anchor screw as installed through key aperture in said shield plate.

Referring to the drawings the present door lock-keeper security shield plate, here in after referred to as shield plate 10. The elongated main anchoring screw of which can have various types of screw heads depending on shield plate 10 used, here in after referred to as screw 44.

Figure 1B:
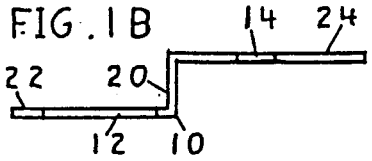
Figure 1C:
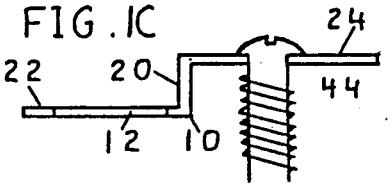

The perspective view of the improved shield plate 10 of FIG. 1A is stamped from a single small sheet comprising a thin sheet metal member formed in a zig-zag shape better shown in FIG. 1B a center section upset 20 for a door stop rail 32 and two integrally formed angle plates in alternate direction, one a lower face plate 22 defines an opening 12 for passage of the lock bolt 40 to pass through when locking and unlocking a dead bolt lock 38 or the like. Said face plate 22 also has two conical countersunk holes 54 for two flat head self threading screws 56 for securing shield plate 10 in correct position before drilling pilot hole through aperture 14 for screw 44, an upper plate 24 defines the key aperture 14 in a preferred location at crossing of lines 4—4 and 5—5 of FIG. 1A. Screw 44 is shown through aperture 14 FIG. 1C of face plate 24. The preferred key position of aperture 14 FIG. 1A is a very important part of shield plate 10 said aperture 14 is to receive the main large, long anchor screw 44 to secure said shield plate 10 in a firm position as shown in FIG. 6 said key location of aperture 14 and main screw 44 as assembled with said shield plate 10 on a said door frame 34 lock rail and a swingable door 42 hinged to said door frame 34 said door having a tubular dead bolt lock assembly or the like mounted on said door and door frame, position of aperture 14 becomes the key position of screw 44 with said door 42 in a closed position the exterior lock 38 cylinder rim of said lock assembly becomes an important part of the said key location of said aperture 14 and screw 44, said exterior lock cylinder rim of lock 38 with door 42 closed virtually prevents unscrewing said screw 44 with a screw driver or a similar undoit tool, see FIG. 6 space 71 of the said locking assembly in space relation to the assembly of shield plate 10 said assemblies virtually prevent tampering with or removing said screw 44.

Figure 2A:
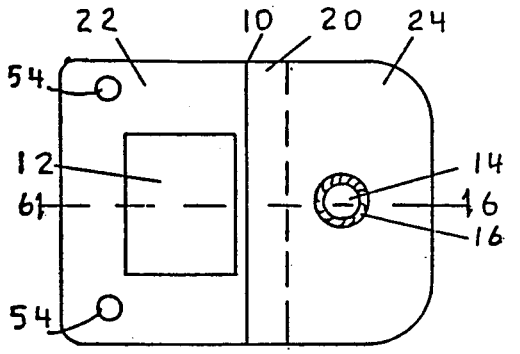
FIG. 2A is a perspective view of the invention of FIG. 1A with a slightly modified main anchor aperture.
Figure 2B:
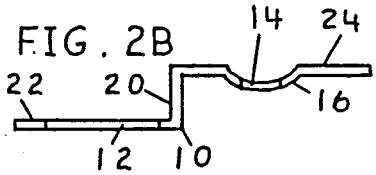
FIG. 2B is a cross section view of said shield plate taken along line 6—6 of FIG. 2A.
Figure 2C:
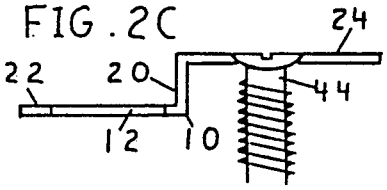
FIG. 2C is a side view showing main anchor screw in relation to said modified surface at key aperture illustrating the conical countersunk around said aperture stamped in said shield plate.
Figure 3A:
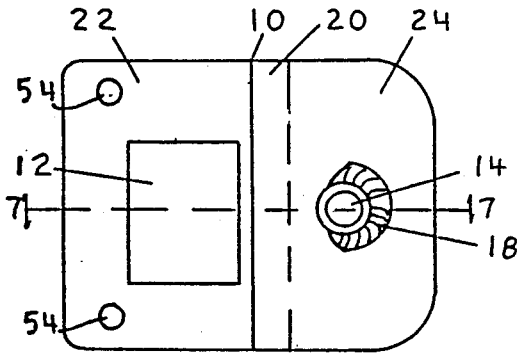
FIG. 3A is a perspective view of yet another modified shape on the surface at the key aperture.
Figure 3B:
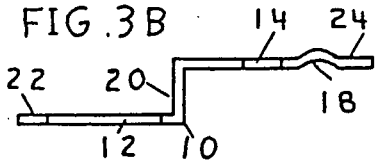
FIG. 3B is a cross section view of said shield plate taken along line 7—7 of FIG. 3A.
Figure 3C:
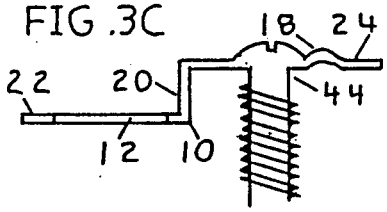
FIG. 3C is a side view of the invention showing the main anchor screw in relation to modified surface at key aperture illustrating the cove semi-circle stamped in said shield plate.
Figure 4A:
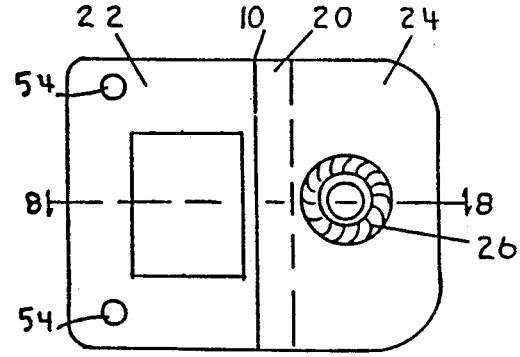
FIG. 4A is a perspective view of the invention in another modified surface around key aperture.
Figure 4B:
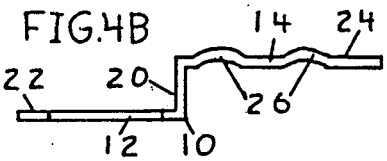
FIG. 4B is a cross section view taken along line 8—8 of FIG. 4A.
Figure 4C:
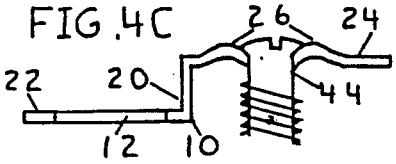
FIG. 4C is a side view showing main anchor screw in relation to said modified surface at key aperture, illustrating the cove circle stamped in said shield plate.
Figure 6:
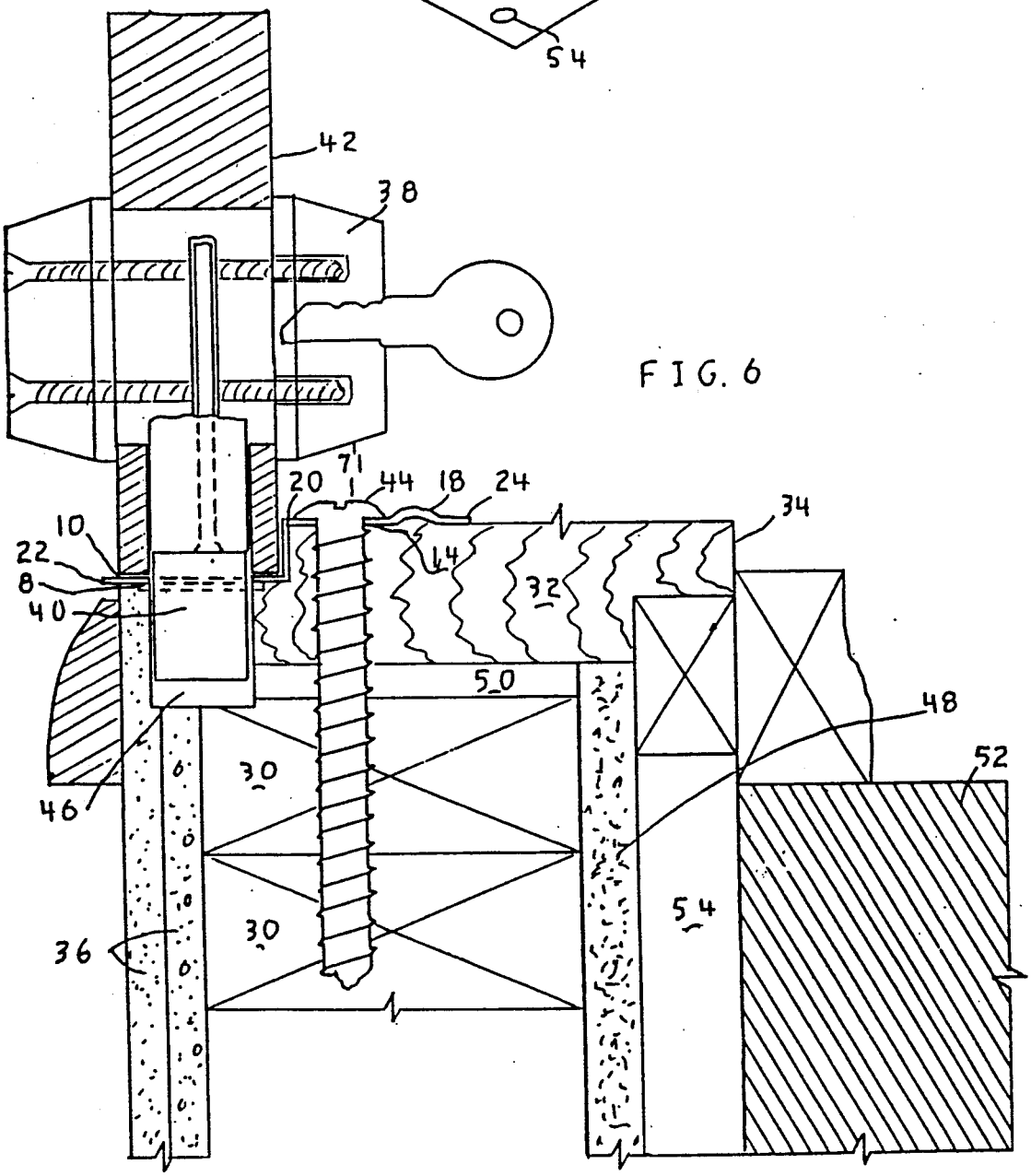
FIG. 6 is a plan elevation of my invention shown in operative relation with a tubular dead bolt lock assembly complete with the lock-keeper and lock cylinder, a door and door frame, wall combination section shown in fragment with the main elongated screw anchoring the lock-keeper security shield plate through the key aperture in the preferred position shown at crossing of lines 2—2 and 3—3 of FIG. 5.

FIG. 2A is of the same structure and assembly as FIG. 1A except the modified surface of face plate 24 being a countersunk forming a conical recess 16 around aperture 14 as also shown in FIG. 2B to receive a flat head screw 44 shown in FIG. 2C said modified aperture 14 location and said screw 44 assembly will virtually prevent drilling or cutting off said screw 44 head when said shield plate 10 of FIG. 2A is mounted as FIG. 3A shown in FIG. 6. FIG. 3A another figure of the same structure as FIG. 1A except the modified surface of face plate 24 to include a cove semi-circle 18 at outer edge of the aperture 14 as better shown in FIG. 3B, FIG. 3C also shows a round or truss head screw 44 installed there through said modified aperture 14, said cove semi-circle 18 virtually prevents tampering with said screw 44 head or chisling said head off also prevents the use of a clamping tool to loosen said screw 44. FIG. 4A is still another figure of the same structure as FIG. 1A except the modified surface plate 24 showing a cove circle 26 around outer edge of aperture 14 showing the raised cove circle in FIG. 4B. FIG. 4C shows a oval head screw 44 seated in the full cove circle 26 provides a countersunk for a flat or oval head screw 44 which also prevents tampering or removing said screw 44 when mounted as FIG. 3A in FIG. 6.

Figure 8:
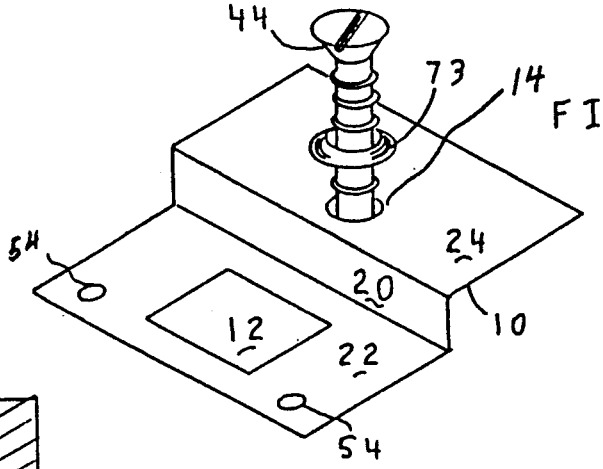
FIG. 8 is a perspective view of the invention that shows a plan of FIG. 1 with a modified anchor means using a countersunk finish washer and a flat head main anchor screw.

FIG. 8 is another figure of the same structure as FIG. 1A shield plate 10 except FIG. 8 shows a plan using a countersunk washer 73 aligned with aperture 14 of FIG. 1A with a flat head main anchor screw 44 said washer 73 will slip if a clamping tool is used to attempt removal of screw 44 and said washer 73 narrows space 71 FIG. 6 door closed that further prevents tampering.

Preferred location of key aperture 14 provided for screw 44 as shown in FIG. 5 at crossing of lines 2—2 and 3—3 said location does not rule out surrounding area for aperture 14 that is in space relation thereto registering with said dead bolt lock 38 cylinder rim edge as shown in FIG. 6 which will prevent said screw 44 from being removed by unscrewing door closed.

FIG. 5 illustrates one embodiment of several FIGS. 1A–4A of shield plate 10 shield plate assembly of FIG. 3A as installed in a typical application as shown mounted on a door frame 32 and exterior wall combination in fragment FIG. 5 is a pictorial view of the said assembly as would be viewed with door 42 open showing face plate 22 which defines a lock bolt opening 12 mounted over a existing lock-keeper 8 which has a lock bolt opening 9 with said opening 9 and 12 aligned over a socket hole 46 in jamb lock rail 32 for a dead bolt 40 of lock 38 or the like to pass through when locking or unlocking said lock; said view also shows face plate 24 that laps onto portion of face of door jamb 32 stop rail 34; showing the preferred position of the key aperture 14 being at cross lines 2—2 and 3—3 FIG. 5 for screw 44 head seated in relation to cove semi-circle 18 for added security of said screw 44.

FIG. 6 illustrates a plan elevation of my invention drawn to scale ¾" to 1" to better show the assembly of and relation to all parts to explain the added security of shield plate 10 screw 44 in relation with a tubular dead bolt lock assembly and how one zig-zag shape shield plate 10 with key aperture 14 will fit all width door jambs 32 and all width stop rails 34.

The present lock-keeper security shield plate 10 used in combination with said tubular dead bolt lock 38 or the like to include lock-keeper 8 as shown assembled in FIG. 6 on a door frame 32 with a door stop rail 34 a door 42 which is hinged (hinged side not shown) within said door frame 32 which is fitted between double studs members 30 provided on each side of a door frame opening of a wall for a door frame.

The basic assembly for the exterior door jamb for a building construction such as a house as shown in fragment FIG. 6 includes items that cause wall thickness to vary in turn causes the door frame 32 and stop rail 34 to vary in face width, construction items of an exterior said wall that vary in width are wall studs 30 and items that vary in thickness are interior wall surface covering such as lath and plaster 36 or dry wall if used and exterior of said wall thickness of storm sheeting 48 nailed to stud walls open space 54 is means for laying brick veneer 52, wood or other exterior siding is nailed directly to wall over said sheeting 48 there by eliminating said space 54, shield plate 10 is designed and shaped to fit any width door frame 32 or door 34 that said variation cause without modification of shape of shield plate 10 or any modification of said wood door frame 32 lock rail 34.

The assembly of all said parts shown in FIG. 6 of shield plate 10 of FIG. 3A mounted on jamb lock rail 34 over existing dead bolt lock-keeper 8 disposed in said recess with hole 9 and hole 12 defined in face plate 22 of shield plate 10 aligned over socket hole 46 in jamb lock rail for the lock bolt 40 of said lock to pass through in a lock position and retract to unlock and face plate 24 defining a key aperture 14 with cove semi-circle 18 around outer edge of said aperture 14 receiving the main elongated anchor screw 44 in a pilot hole drilled through jamb 32 door stop rail 34 and studs 30 with screw 44 passing through aperture 14 and threading through jamb stop rail 34 passing through open space 50 and threading well into double studs 30 of framed opening positioning said screw 44 outward from inner edge of said studs 30 more toward the center which will prevent said studs from splitting when body force or hard kicks are applied in the lock area of the exterior of a door. The key position of aperture 14 provides for main anchor screw 44 in space relation to and registering with rim edge of said exterior lock cylinder of the tubular dead bolt lock 38 or the like prevents said screw 44 from being unscrewed to back out for removal of said screw (door closed) the small space 71 between said lock 38 cylinder rim and said screw 44 head with the cove semi-circle 18 virtually prevents tampering or removal of said screw 44 by a would be intruder with any undoit tool, or screwdriver or a clamping tool such as vice clamps or the like, (door closed and locked).

My invention assembly of an improved lock-keeper security shield plate 10 screw 44 will add the reinforcement and security needed to existing dead bolt lock-keeper and tubular dead bolt lock to prevent force opening of a door by a would be intruder using body force or hard kicks in exterior of a door lock area to force the said door open.

FIG. 7 the cross section of an interior door jamb lock rail 33 with door stop rail 35 in center of said jamb rail 33 with recesses 37 for a door to be installed on either side in a home or one each side of joining rooms which are common in hotels, shield plate 10 can be mounted without modification of said shape or any modification of a said door frame.

The method of installing the present lock-keeper security shield plate 10 to a door frame lock rail comprises the following simple steps:

(1) Positioning the shield plate over existing conventional lock-keeper with upset 20 against the door stop lip of rail 34 and align the said lock bolt hole 12 vertically with the lock bolt hole 9 of existing lock-keeper 8.

(2) Drive the two self threading screws through opening provided in lower face plate 22, holds shield plate 10 in place.

(3) Drill a pilot hole through aperture 14 in upper face plate 24 through door frame 32 stop rail 34 and double 2×4 studs 30 framing of opening for said door frame 32.

(4) Insert said long main full body self threading anchor screw 44 through said aperture 14 and with a screwdriver drive said screw 44 all the way to interlock with said studs 30 will prevent the shield plate 10 from being dislodged with a force which could be reasonable expected such as a kick or body force to the door.

The present invention a lock-keeper security shield plate 10 is easily and economically produced in quantity in regular high production manufacture and would add only a little in material and weight so it can be included in regular tubular dead bolt lock package for new work to be added after the conventional lock-keeper has been installed for the proper door to door stop lip 34 adjustment and in some installation said shield plate 10 may be mounted on new installation as the prime lock-keeper.

A full body self threading screw 44 with deep cut threads allow said pilot hole of the diameter of body of said screw to be drilled to a depth beyond the length of said screw 44, with said screw 44 threaded through said pilot hole will provide support to help prevent jamb rail from being spread away from door edge at the lock area which may not have been shimmed between said studs and said jamb rail in said area when said door frame was installed.

I claim:

1. Means to resist forceable entry through a tubular dead bolt locked door which is swingable with relation to a fixed surrounding door frame having a bolt receiving socket and an adjacent lock-keeper plate recess with a said lock-keeper plate disposed in said recess and anchored with two screws, said means comprising a zig-zag shaped reinforcement lock-keeper security shield plate mounted on said door frame overlying said lock-keeper, said shield plate having an upset center and two alternate angle plates a lower plate and an upper plate said lower plate defines an opening for passage of said deadbolt and two holes to receive screws for anchoring said shield plate to said door frame when aligning said lock bolt opening over and in registry with the said lock bolt opening in said conventional lock-keeper with each said bolt opening aligned and in registry with the said bolt receiving socket in said door frame; said upper plate laps onto a portion of face of said door stop rail of said door frame, said upper plate defining a key positioned aperture receiving a main elongated anchor screw means securing to the said reinforcement shield plate which overlies the said conventional lock-keeper, said aperture for said anchor screw means to pass through, threading through said jamb rail and passing through an open space and continue threading into adjacent wall studs framing of said door iamb opening a distance of about three inches, a head of said main anchor screw means being in registry within a space relation to said dead bolt exterior lock cylinder rim edge with said door closed is that said lock cylinder rim virtually prevents tampering and prevents removing said anchor screw means.

2. The structure of claim 1 and said key aperture comprising a conical countersink around said aperture to receive a flat head of said screw means to prevent further tampering with said screw means head.

3. The structure of claim 1 and said key aperture comprising a raised cove semi-circle at the outer edge of said aperture to prevent tampering with a round or truss head of said main anchoring screw means.

4. The structure of claim 1 and comprising a raised cove circle around the edge of said key aperture to receive a flat or oval head said anchor screw and further prevent tampering with said screw head.

5. An improved lock-keeper security shield plate for use in combination with a tubular dead bolt lock assembly mounted on the swingable edge-face of a door hinged within a door jamb including an upright rail, a peripheral door stop and wall framing studs around said door frame opening, said door jamb upright rail having a dead bolt receiving socket and an adjacent lock-keeper plate recess, with a said lock-keeper plate of said dead bolt lock assembly mounted in said recess and anchored with two small screws, said shield plate comprising a zig-zag shape reinforcing lock-keeper security shield plate having a center upset for said door stop rail and two integrally formed plane angle plates, one a lower plate in overlying relation to the said conventional lock-keeper plate disposed in said recess that is adjacent and in registry with said dead bolt socket in said jamb and said shield plate anchored to said jamb with the two screws one above and one below said existing lock-keeper plate; said shield upper plane plate lapping onto a portion of said door stop rail face, said plane upper plate defining a circular key aperture and having added a countersunk finish washer overlying in registry with said aperture, said washer for receiving a flat head of said main elongated anchor screw means for anchoring said shield plate firmly to said door jamb, and framing studs there behind, and said location of said key aperture positions said washer and said screw head in registry with and in space relation to said dead bolt exterior lock cylinder rim edge with said door closed, said rim edge of said cylinder preventing tampering with said screw and prevents said screw from being unscrewed for illegal removal.

6. In the lock-keeper security shield plate of claim 1 where in said shield is formed in a said zig-zag with shape with a said upset and two alternate intergal formed angle plates one said shaped shield plate will fit all variations of widths of said door frames and door stop rails, said key aperture location may vary as long as it is in space relation there to registering with a said deadbolt lock cylinder rim edge.

7. An improved lock-keeper reinforcing security shield plate assembly mounted on a door jamb structure adjacent a door-stop thereof; a door-bolt means mounted on an adjacent door for reception in a bolt opening means formed in the door jamb; said shield plate being formed being formed of two laterally offset plate portions joined at adjacent edges by a central plate portion; one of said offset plate portions having an opening formed to overly said bolt opening means and shaped to receive said door bolt means; the other of said offset plate portions having an aperture receiving a headed screw fastener of length sufficient that it penetrates two adjacent studs which form a part of said door jamb structure; the aperture and screw fastener being located so that the head of said screw fastener lies adjacent a rim part of said door-bolt means mounted on said door when said door is in closed position and said door bolt is in position of entry into said bolt opening means, so that effective removal of said screw by an intruder is prevented.

8. The structure of claim 7, wherein said other of said offset plate portions has an upraised ridge means which surrounds at least a portion of said screw fastener head to prevent tampering with said screw fastener head.

* * * * *